US007636543B2

(12) United States Patent
Mandel et al.

(10) Patent No.: US 7,636,543 B2
(45) Date of Patent: Dec. 22, 2009

(54) RADIAL MERGE MODULE FOR PRINTING SYSTEM

(75) Inventors: Barry Paul Mandel, Fairport, NY (US); Injae Choi, Webster, NY (US); Joannes N. M. Dejong, Hopewell Junction, NY (US); Steven Robert Moore, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 458 days.

(21) Appl. No.: 11/292,163

(22) Filed: Nov. 30, 2005

(65) Prior Publication Data

US 2007/0120305 A1 May 31, 2007

(51) Int. Cl.
*G03G 15/00* (2006.01)

(52) U.S. Cl. ..... 399/407; 400/605; 400/607.2

(58) Field of Classification Search ..... 399/383, 399/388, 391, 407, 410, 403; 400/605, 607, 400/607.1, 607.2, 608.4
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,090,683 | A | 2/1992 | Kamath et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Ren Yan
(74) *Attorney, Agent, or Firm*—Fay Sharpe LLP

(57) ABSTRACT

A merge module suited to use in a printing system in which streams of marked print media arrive at angularly spaced directions from two marking engines includes a first media transport section which receives a first portion of print media and outputs it in a first direction. A second media transport section receives a second portion of print media. The second print media transport section redirects the second portion of print media, optionally rotates it, and outputs it in the first direction. A third media transport section receives a third portion of print media. The third media transport section redirects the third portion of print media, optionally rotates it, and outputs it in the first direction. Print media output from one marking engine may be alternately delivered to the second and third transport sections. An output path receives print media from the three media transport sections.

20 Claims, 10 Drawing Sheets

U.S. PATENT DOCUMENTS

| | | | |
|---|---|---|---|
| 5,629,762 | A | 5/1997 | Mahoney et al. |
| 5,710,968 | A | 1/1998 | Clark et al. |
| 5,778,377 | A | 7/1998 | Marlin et al. |
| 5,836,439 | A | 11/1998 | Coyette |
| 5,884,910 | A | 3/1999 | Mandel |
| 5,931,462 | A | 8/1999 | Delfosse |
| 5,995,721 | A | 11/1999 | Rourke et al. |
| 6,059,284 | A | 5/2000 | Wolf et al. |
| 6,125,248 | A | 9/2000 | Moser |
| 6,241,242 | B1 | 6/2001 | Munro |
| 6,297,886 | B1 | 10/2001 | Cornell |
| 6,341,773 | B1 | 1/2002 | Aprato et al. |
| 6,384,918 | B1 | 5/2002 | Hubble, III et al. |
| 6,450,711 | B1 | 9/2002 | Conrow |
| 6,476,376 | B1 | 11/2002 | Biegelsen et al. |
| 6,476,923 | B1 | 11/2002 | Cornell |
| 6,493,098 | B1 | 12/2002 | Cornell |
| 6,537,910 | B1 | 3/2003 | Burke et al. |
| 6,550,762 | B2 | 4/2003 | Stoll |
| 6,554,276 | B2 | 4/2003 | Jackson et al. |
| 6,577,925 | B1 | 6/2003 | Fromherz |
| 6,607,320 | B2 | 8/2003 | Bobrow et al. |
| 6,608,988 | B2 | 8/2003 | Conrow |
| 6,612,566 | B2 | 9/2003 | Stoll |
| 6,612,571 | B2 | 9/2003 | Rider |
| 6,621,576 | B2 | 9/2003 | Tandon et al. |
| 6,633,382 | B2 | 10/2003 | Hubble, III et al. |
| 6,639,669 | B2 | 10/2003 | Hubble, III et al. |
| 6,811,152 | B2 | 11/2004 | Delfosse et al. |
| 6,819,906 | B1 | 11/2004 | Herrmann et al. |
| 6,925,283 | B1 | 8/2005 | Mandel et al. |
| 6,959,165 | B2 | 10/2005 | Mandel et al. |
| 2002/0078012 | A1 | 6/2002 | Ryan et al. |
| 2002/0103559 | A1 | 8/2002 | Gartstein |
| 2003/0077095 | A1 | 4/2003 | Conrow |
| 2004/0085561 | A1 | 5/2004 | Fromherz |
| 2004/0085562 | A1 | 5/2004 | Fromherz |
| 2004/0088207 | A1 | 5/2004 | Fromherz |
| 2004/0150156 | A1 | 8/2004 | Fromherz et al. |
| 2004/0150158 | A1 | 8/2004 | Biegelsen et al. |
| 2004/0153983 | A1 | 8/2004 | McMillan |
| 2004/0216002 | A1 | 10/2004 | Fromherz et al. |
| 2004/0225391 | A1 | 11/2004 | Fromherz et al. |
| 2004/0225394 | A1 | 11/2004 | Fromherz et al. |
| 2004/0247365 | A1 | 12/2004 | Lofthus et al. |
| 2004/0253033 | A1 | 12/2004 | Lofthus et al. |
| 2005/0158094 | A1 | 7/2005 | Mandel et al. |

OTHER PUBLICATIONS

Desmond Fretz, "Cluster Printing Solution Announced", Today at Xerox (TAX), No. 1129, Aug. 3, 2001.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2005, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/235,979, filed Sep. 27, 2005, Anderson et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/236,099, filed Sep. 27, 2005, Anderson et al.
Filed contemporaneously herewith, Lang.

RADIAL MERGE MODULE FOR PRINTING SYSTEM

CROSS REFERENCE TO RELATED PATENTS AND APPLICATIONS

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Robert M. Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/137,251, filed May 25, 2005, entitled "SCHEDULING SYSTEM," by Robert M. Lofthus, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,961, filed Jun. 24, 2005, entitled "PRINTING SYSTEM SHEET FEEDER," by Steven R. Moore;

U.S. application Ser. No. 11/166,299, filed Jun. 24, 2005, entitled "PRINTING SYSTEM," by Steven R. Moore;

U.S. application Ser. No. 11/248,044, filed Oct. 12, 2005, entitled "MEDIA PATH CROSSOVER FOR PRINTING SYSTEM", by Stan A. Spencer, et al.; and U.S. application Ser. No. 11/291,583 filed contemporaneously herewith, entitled "MIXED OUTPUT PRINTING SYSTEM," by Joseph H. Lang.

INCORPORATION BY REFERENCE

The following references, the disclosures of which are incorporated herein in their entireties by reference, are mentioned:

U.S. Pat. No. 6,925,283, issued Aug. 2, 2005, entitled "HIGH PRINT RATE MERGING AND FINISHING SYSTEM FOR PRINTING," by Mandel, et al. and U.S. Pat. No. 6,959,165, issued Oct. 25, 2005, entitled "HIGH PRINT RATE MERGING AND FINISHING SYSTEM FOR PRINTING," by Mandel, et al. disclose a system for printing media which includes a plurality of marking engines for outputting printed media in a stream, a media path system operable to transport the printed media from the marking engines to one or more finishing stations such that the streams are merged and transported one on top of the other and one or more finishing stations capable of compiling media in groups of two or more sheets for post-processing the printed media into one or more completed jobs.

U.S. Published Application No. 2005/0158094, published Jul. 21, 2005, entitled "HIGH PRINT RATE MERGING AND FINISHING SYSTEM FOR PARALLEL PRINTING," by Mandel, et al. discloses a system for printing media which includes a media path system operable to transport printed media from marking engines to one or more finishing stations such that the streams are merged and transported one on top of the other. The media path system includes first and second path sections that transport media in opposite directions along parallel paths, and a third path section that merges into and out of the first and second path sections such that media traveling along any of the first, second, or third path sections may be routed to any other of the first, second, or third path sections.

U.S. Published Application No. 2002/0141805, published Oct. 3, 2002, entitled "MOBIUS COMBINATION OF REVERSION AND RETURN PATH IN A PAPER TRANSPORT SYSTEM," by Bobrow, et al. discloses an apparatus for processing a substrate on two sides which includes a reversion pathway adapted to receive a substrate from an input pathway and invert the substrate and return the reverted substrate to the input pathway and a merge point for merging the reverted substrate into the input pathway.

U.S. application Ser. No. 11/166,581, filed Jun. 24, 2005, entitled "MIXED OUTPUT PRINT CONTROL METHOD AND SYSTEM," by Joseph H. Lang, et al. discloses a merging module which connects two print engines at approximately 90 degrees to one another. The merging module includes a sheet rotator in a plane that is common to the paper paths of both print engines and a buffer which stores printed sheets. The module also includes two bypass paths, one above and one below the rotator, to route the two paper paths around the rotator and enable both print engines to deliver their output to the appropriate finishing device as well as to the buffer.

U.S. Pat. No. 5,090,683, issued Feb. 25, 1992, entitled "ELECTRONIC SHEET ROTATOR WITH DESKEW, USING SINGLE VARIABLE SPEED ROLLER," by Kamath, et al. discloses a device for selectively turning documents which includes first and second drive rollers aligned along an axis which is transverse to a process direction along which documents are fed, and first and second follower rollers cooperatively peripherally aligned with the first and second drive rollers, respectively. One of the drive rollers is operated at a substantially constant peripheral velocity by a first drive which is a constant velocity motor while the other drive roller is operated at a variable peripheral velocity by a variable speed drive so that the document is turned. Thus, only a single variable speed drive, such as, for example a stepper motor or servo system, is required. The variable speed drive is driven through a variable velocity profile to control the amount of rotation of the document, such as turning the document approximately 90 degrees. An additional mechanism can be provided for shifting the connection of the constant velocity and variable speed motors between the first and second drive rollers so that a sheet can be rotated in opposite directions.

U.S. Pat. No. 5,931,462, issued Aug. 3, 1999, entitled "METHOD OF SHEET ROTATION AND A SHEET STACKER WITH A SHEET ROTATOR," by Delfosse discloses a method for producing a desired sheet orientation between upstream and downstream positions of a sheet path along which sheets travel successively in a predetermined sheet travel direction. Each sheet is driven uniformly along the path with an intermediate phase in which the sheet is driven differentially to rotate the sheet without changing its velocity component in the sheet travel direction.

U.S. Pat. No. 6,811,152, issued Nov. 2, 2004, entitled "METHOD AND DEVICE FOR CONTROLLING THE ORIENTATION AND ALIGNMENT OF INDIVIDUAL SHEETS OF PAPER PASSING ON A CONVEYOR," by Delfosse, et al. discloses a method of controlling the orientation and the alignment of individual sheets of paper traveling on a sheet conveyor. Each sheet passes over a pair of closely spaced rotating disks inserted between upstream and downstream sheet conveyor sections. Each sheet is locally engaged with each disk in a limited contact area. The contact areas between the sheet and each disk are varied so as to achieve a target orientation or alignment of the sheet.

U.S. Pat. No. 5,836,439, issued Nov. 17, 1998, entitled "DEVICE FOR THE ROTATION OF SHEETS ON A ROLLER CONVEYOR," by Coyette discloses a device for turning through 90 degrees sheets passing at a rapid rate over a roller conveyor in a horizontal plane. The device includes a pair of rollers entrained in rotation at different speeds and spaced apart from each other and from a longitudinal guide on the conveyor transversely with respect thereto. Each of the rollers has its rotation axis inclined with respect to the normal on this guide, by a specified angle which is greater for the roller which is closest to the guide and the rotation speed of which is the smaller. Each of the rollers has its periphery in contact with a support ball or with the lower face of a sheet during its passage, substantially in said transport plane.

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages), and "output merger" or "interposer" systems: U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,489,969 to Soler, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

BACKGROUND

The exemplary embodiment relates to sheet transport systems. It finds particular application in a printing system in which output streams of print media traveling in different directions from two or more marking engines are merged into a combined stream.

Electronic printing systems, such as laser printers and copiers, typically employ an input terminal which receives images in digital form and conversion electronics for converting the image to image signals or pixels. The printing system may include a scanner for scanning image-bearing documents or be connected to a computer network which supplies the digital images. The signals are stored and are read out successively to a marking engine for formation of the images and transfer of the images to a print medium, such as paper.

Cluster printing systems enable high print speeds or print rates by grouping a number of slower speed marking engines in parallel. These systems also enable output to be maintained, albeit at a slower speed, if one marking engine fails, through redirection of a print job to the remaining marking engines. Parallel printing systems have been developed which employ multiple marking engines for black, process (or full) color, and custom color (single color or monochrome) printing of selected pages within a print job. For example one marking engine prints even pages of a print job on one set of sheets while another marking engine prints the odd pages on a second set of sheets. The outputs of the marking engines are automatically combined in page order and delivered to a common finisher, such as an output tray.

Merging sheets from two paths into a single path has been achieved by aligning one stream with the other and merging the streams. However, the pathways needed for conveying one stream from a first marking engine over a second marking engine, which generates the second stream, and then bringing the two streams into alignment, tend to be lengthy. Additionally, in large, high speed printing systems, it has been found difficult to provide a bypass path over or under one of the marking engines.

BRIEF DESCRIPTION

Aspects of the exemplary embodiment relate to a printing system, a merge module suited to use in a printing system, and to a method of printing.

In one aspect, a printing system includes a first marking engine which outputs a first stream of print media, a second marking engine which outputs a second stream of print media, and a merge module which receives the first and second streams from angularly spaced directions. The merge module includes a first media transport section which receives print media from the first stream of print media and outputs the print media in a first direction and a second media transport section and a third media transport section which selectably receive print media from the second stream of print media. The second and third media transport sections are configured for redirecting the print media from the second stream whereby the print media from the second print media stream is oriented in the first direction for merging with the printed media from the first stream. An output path is coupled with the first media transport section and the second and third media transport sections in which the print media from the first and second streams are merged.

In another aspect, a merge module includes a first media transport section which receives a first portion of print media and outputs the first portion of print media in a first direction and a second media transport section which receives a second portion of print media, the second print media transport section redirecting the second portion of print media and outputting the second portion of print media in the first direction. A third media transport section receives a third portion of print media. The third media transport section redirects the third portion of print media and outputs the third portion of print media in the first direction. An output path receives print media from the first, second, and third media transport sections, in which the first, second, and third portions of print media are merged.

In another aspect, a method of printing includes supplying a first stream of print media to a first media transport section of a merge module for merging with a second stream of print media. The first stream of print media is output from the first media transport section in a first direction. A first portion of the second stream of print media is supplied to a second media transport section of the merge module. A second portion of the second stream of print media is supplied to a third media transport section of the merge module. The second stream of print media is redirected in the second and third media transport sections from a second direction to the first direction. The first and second portions of the second stream of print media are output from the second and third media transport sections in the first direction and the first and second streams are merged.

In another aspect, a printing system includes a first marking engine which outputs a first stream of printed sheets in a first direction of travel. A second marking engine outputs a second stream of printed sheets in a second direction of travel which is angularly spaced from the first direction of travel. A merge module receives the first and second streams of printed sheets and reorients at least one of the first and second streams for merging the first and second streams into a combined stream. The merge module includes a first transport section which receives sheets from the first stream of printed sheets, conveys the received sheets in a first plane, and outputs the sheets from the first stream in a third direction of travel which is different from at least one of the first and second directions. The merge module includes at least a second transport section which conveys sheets in a second plane which is vertically spaced from the first plane, the second transport section receiving sheets from the second stream of printed sheets and outputs the sheets from the second stream in the third direction. At least one of the first and second transport sections is configured for changing a direction of travel of sheets and optionally rotating the sheets such that the sheets output by the first and second merge module merge into the combined stream. An output destination receives the combined stream of sheets from the merge module.

DETAILED DESCRIPTION

Aspect of the exemplary embodiment relate to a print media merge module, to a printing system which includes a print media merge module, and to a method of printing. The merge module receives at least two streams of print media from angularly spaced-directions. The merge module includes a first media transport section which receives print media from a first of the print media streams in a first transport plane and second and third media transport sections in second and third transport planes spaced from the first plane, which receive print media from a second of the print media streams. The second and third media transport sections are configured for changing the direction of the print media received from the second stream to the direction of the first print media stream and may also rotate the print media from the second print media stream prior to the print media merging with the print media from the first stream.

A printing system includes a media path such that the sheets printed by a plurality of marking engines can be merged into a single stream, at a location upstream of one or more finishers. The printing system may include first and second marking engines and a conveyor system which conveys the print media between the marking engines and the merge module and conveys a merged stream from the merge module to the finisher.

The term "marking engine" generally refers to a device for applying an image to print media. The exemplary printing system may include marking engines and a variety of other components, such as finishers, paper feeders, and the like, and may be embodied as a copier, printer, or a multifunction machine. "Print media" can be a usually flimsy physical sheet of paper, plastic, or other suitable physical print media substrate for images. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. While the exemplary printing system is described with particular reference to a xerographic printing system in which the colorants comprise dry toners applied in an electrophotographic process, it is also contemplated that the printing system may employ liquid or solid inks or other colorants, such as an inkjet printer. A "finisher" can be any post-printing accessory device such as a tray or trays, sorter, mailbox, inserter, interposer, folder, stapler, stacker, hole puncher, collater, stitcher, binder, envelope stuffer, postage machine, or the like. The operation of applying images to print media, for example, graphics, text, photographs, etc., is generally referred to herein as printing or marking.

Figure 1:
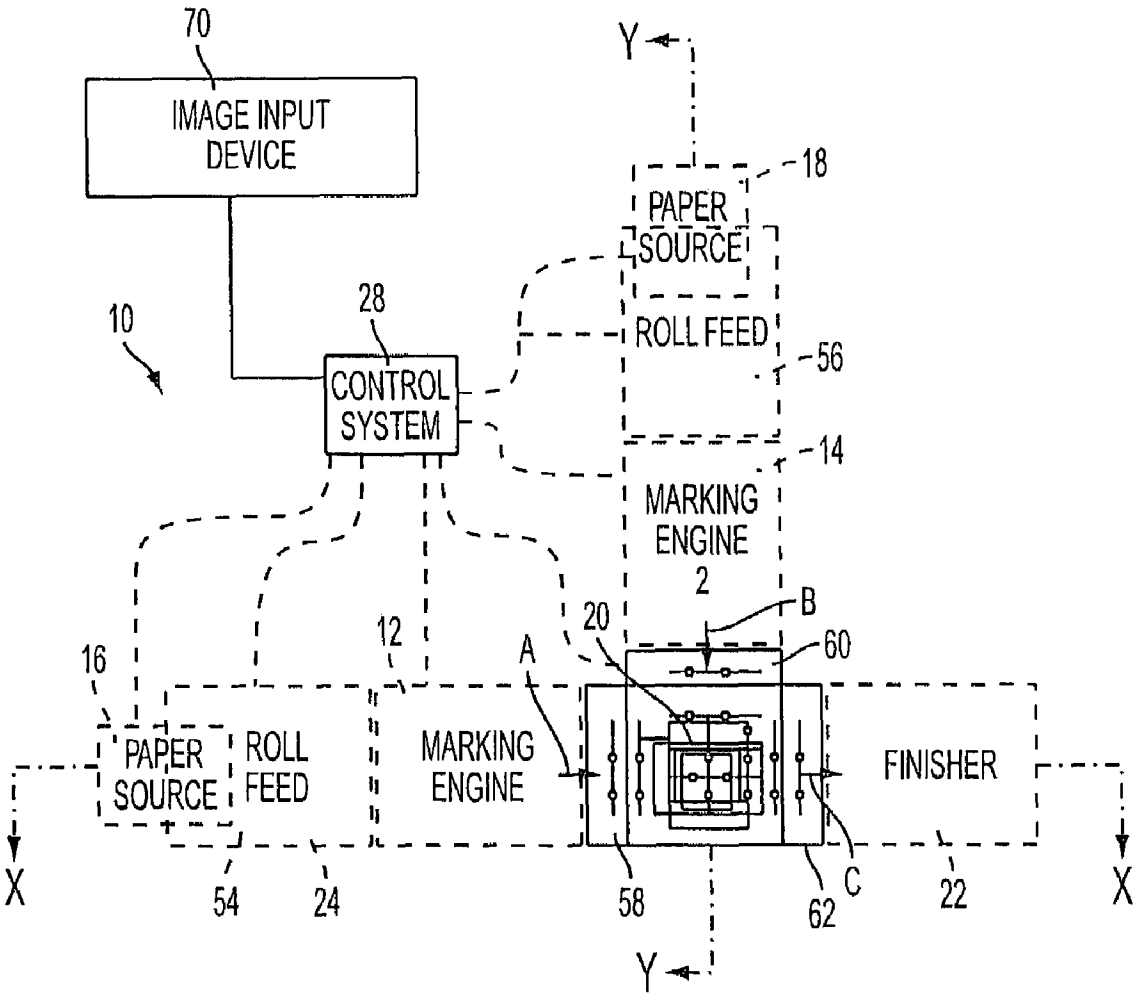
FIG. 1 is a schematic top plan view of an exemplary printing system according to a first aspect of the exemplary embodiment.

With reference to FIG. 1, a printing system 10 is illustrated schematically. The illustrated printing system 10 includes first and second marking engines 12, 14, each with an associated print media source 16, 18, a merge module 20, and an output destination, such as a finisher 22 or another marking engine, all interconnected by a print media conveyor system 24. Print media is conveyed to from the respective print media source 16, 18, to the marking engines 12, 14, where it is marked. Streams of marked media, illustrated by arrows A and B are transported by the conveyor system 24 from the marking engines 12, 14 to the merge module 20, where the streams are combined. The conveyor system 24 conveys the merged stream, illustrated by arrow C, between the merge module 20 and the output destination 22. The operation of some or all the components 12, 14, 16, 18, 20, 22, 24 of the printing system may all be under the control of a common control system 28, whereby sheets of print media are routed through the printing system 10 in the execution of a print job. A print job or jobs employing the paper can be selectively distributed to one or both marking engines 12, 14 for printing. For example, in one mode of printing, both marking engines print pages of the same print job. In a simplex job (where only one side of each sheet is printed), for example, marking engine 12 may print alternate pages, such as the even pages, while marking engine 14 prints the odd pages. The pages are collated in page order at the finisher 22. In a duplex job, for example, marking engine 12 prints both sides of a first, third, fifth sheet, etc. (e.g., pages 1, 2, 5, 6, 9, and 10 etc. of the print job), while marking engine 14 prints both sides of a second, fourth, sixth sheet, etc. (pages 3, 4, 7, 8, 11, 12 of the print job).

While the illustrated printing system 10 includes dedicated print media sources 16, 18, it is also contemplated that both marking engines 12, 14 may be fed with print media from a common high speed print media source by providing suitable paper pathways from the print media source. Additionally, while two marking engines 12, 14 are illustrated, the number of marking engines can be any number, such as one, two, three, four, five, six, or more. Where only one marking engine is employed, the output of the marking engine may be split into two streams for post printing processing, which streams are then directed to the merge module. Providing at least two marking engines typically provides enhanced features and capabilities for the printing system, since marking tasks can be distributed amongst the at least two marking engines. Some or all of the marking engines 12, 14 may be nominally identical to provide redundancy or improved productivity through parallel printing. Alternatively or additionally, some or all of the marking engines 12, 14 may be different to provide different capabilities. For example, the marking engines 10, 12 may be multi-color, e.g., process color (P) marking engines, monochrome engines, such as black (K), custom color (C), or magnetic ink character recognition (MICR) marking engines, or combinations thereof. The marking engines 12, 14 may have the same print speed (in terms of prints per minute, ppm), or different print speeds.

Figure 2:
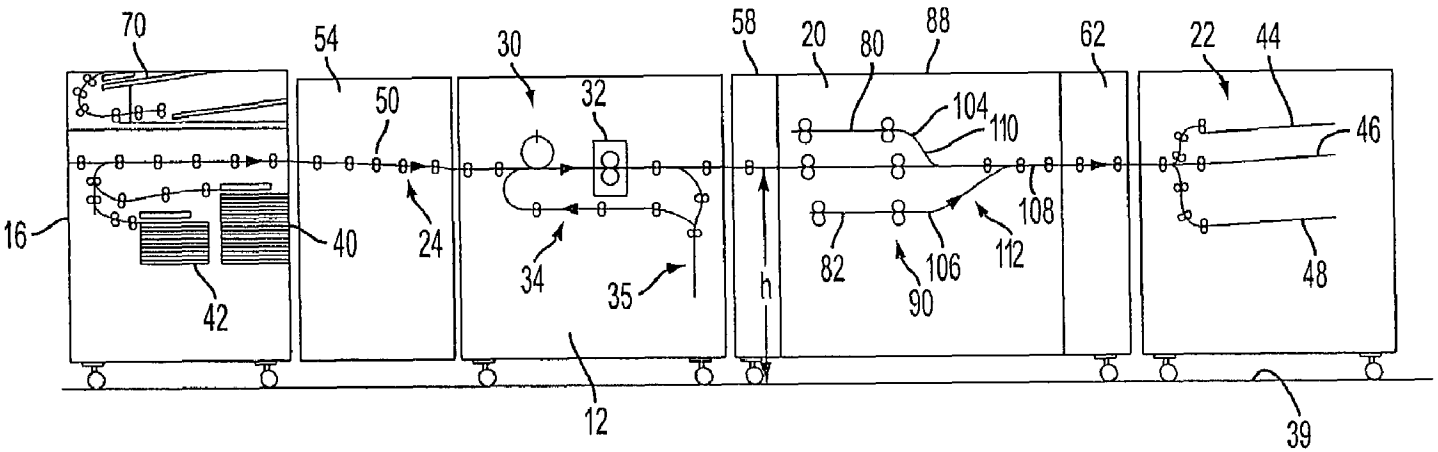
FIG. 2 is a side sectional view of the printing system through X-X.
Figure 3:
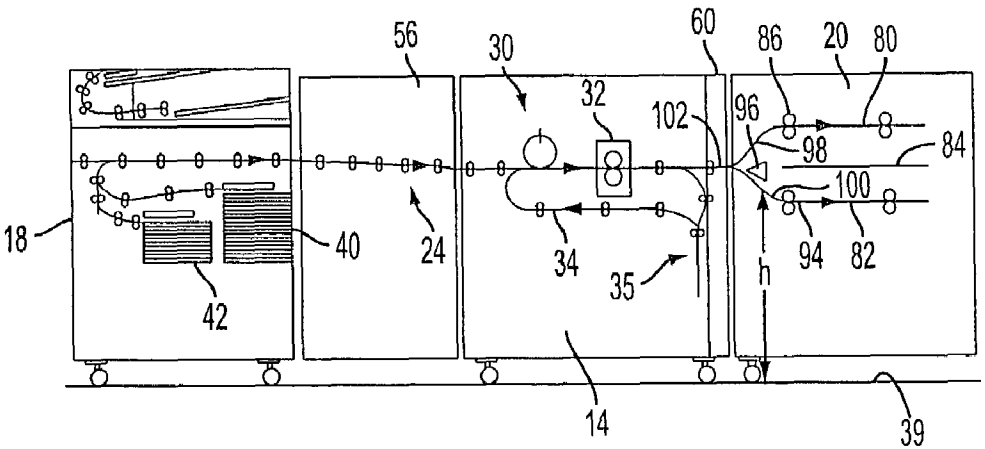
FIG. 3 is a side sectional view of the printing system through Y-Y.

With reference to FIGS. 2 and 3, the illustrated marking engines 12, 14 employ xerographic printing technology, in which an electrostatic image is formed and coated with a toner material, and then transferred and fused to paper or another print medium by application of heat and/or pressure. However, marking engines employing other printing technologies can be provided as processing units, such as marking engines employing ink jet transfer, thermal impact printing, or the like.

In the case of a xerographic device, each marking engine 12, 14 includes various xerographic subsystems for forming an image, transferring the image to a sheet of paper, and fusing the image to attach the image more permanently to the print media. The marking engine typically includes an image applying component, illustrated schematically at 30, which includes a charge retentive surface, such as a rotating photoreceptor in the form of a belt or drum. The images are created on a surface of the photoreceptor. Disposed at various points around the circumference of the photoreceptor are the xerographic subsystems, which include a cleaning device, a charging station for each of the colors to be applied (one in the case of a monochrome marking engine, four in the case of a CMYK printer), such as a charging corotron, an exposure station, which forms a latent image on the photoreceptor, such as a Raster Output Scanner (ROS) or LED bar, a developer unit, associated with each charging station for developing the latent image formed on the surface of the photoreceptor by applying a toner to obtain a toner image, a transfer unit, such as a transfer corotron, transfers the toner image thus formed to the surface of a print media substrate, such as a sheet of paper. A fuser 32 fuses the image to the sheet. The fuser generally applies at least one of heat and pressure to the sheet to physically attach the toner and optionally to provide a level of gloss to the printed media. In any particular embodiment of an electrophotographic marking engine, there may be variations on this general outline, such as additional corotrons, cleaning devices, or, in the case of a color printer, multiple developer units. The xerographic subsystems are controlled by a marking engine controller, such as a CPU, which includes actuators for controlling each of the subsystems. The marking engine controller is linked to the control system 28 and may be also linked to other known components, such as a memory, a marking cartridge platform, a marking driver, a function switch, a self-diagnostic unit, all of which can be interconnected by a data/control bus.

In the illustrated embodiment, each marking engine 12, 14 has a return loop 34. When the marking engine operates in a duplex mode, print media which has been marked in the marking engine is inverted by an inverter 35 and passed through the marking engine a second time for printing on the second side of the sheet.

The first and second streams A, B of print media arrive at the merge module 20 from angularly spaced directions. In the embodiment illustrated in FIG. 1, the marking engines are oriented at an angle θ of approximately 90° (e.g., from about 80° to about 110°), such that the respective output streams A, B exit the marking engines in directions which are also angularly spaced at approximately 90°, and arrive at the merge module 20 in the same relative orientations, although it is also contemplated that the directions of the streams A, B may be otherwise angled, such as at approximately 180° or at angles between 90° and 180° or between 0° and 90°. As illustrated in FIGS. 2 and 3, outputs 36, 38 of the two marking engines may be in the same plane—i.e., at generally the same height h above a support surface 39, such as the ground.

The print media sources 16, 18, may each include a plurality of print media trays 40, 42, which are connected with the print media conveyor system 24 to provide selected types of print media to all of the marking engines. While two print media source trays 40, 42 are illustrated, the number of source trays can be one, two, three, four, five, or more. Each of the print media source trays can store sheets of the same type of print medium, or can store different types of print media.

The print media conveyor system 24 is controllable to acquire sheets of a selected print medium from the print media sources 16, 18, transfer each acquired sheet to the associated marking engine 12, 14 to perform selected marking tasks, and then transfer each sheet to the finisher 22 to perform finishing tasks. The finisher 22 may be in the form of a module which includes one or more print media output destinations 44, 46, 48 herein illustrated by trays. While three output destinations 44, 46, 48 are illustrated, the printing system 10 may include one, two, three, four, or more print media output destinations.

The print media conveyor system 24 includes baffles (not shown), which constrain the print media to move along paper paths, and associated drive elements 50, such as rollers, spherical balls, or air jets, which convey the print media along the paths. The conveyor system 24 may include diverters, inverters, interposers, and the like, as known in the art. In the illustrated embodiment some of the drive elements 50 are incorporated into transport modules 54, 56, 58, 60, 62, which each include at least two pairs of laterally spaced driven rollers.

The printing system 10 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 10 are determined by the capabilities of the paper sources 16, 18, marking engines 12, 14, and finisher 22 of the printing system 10. These capabilities may increase over time due to addition of new components or upgrading of existing components. The capabilities may also decrease over time due to failure or removal of one or more components, such as the failure of one of the marking engines 12, 14. Until a repair or replacement can be effectuated, a print job may be handled by the remaining marking engine(s).

An image input device 70 supplies the printing system 10 with images to be printed. The image input device can include a built-in optical scanner, which can be used to scan a document such as book pages, a stack of printed pages, or the like, to create a digital image of the scanned document that is reproduced by printing operations performed by the printing system 10. Alternatively or additionally, the image input device can include a link to a remote source. For example, a print job can be electronically delivered to the control system 28 via a wired or wireless connection to a digital network that interconnects, for example, personal computers or other digital devices.

The printing system 10 is an illustrative example. In general, any number of print media sources, media handlers, marking engines, finishers or other processing units can be connected together by a suitable print media conveyor configuration. While the printing system 10 employs two marking engines 12, 14 and a finisher 22 in a T-shaped configuration, with the second marking engine 14 in the stem of the T and the first marking engine and finisher forming the head of the T, other physical layouts can be used, such an additional marking engine intermediate marking engine 12 and the merge module 20 and/or an additional marking engine intermediate marking engine 14 and the merge module, or a stacked arrangement, or the like.

Figure 4:
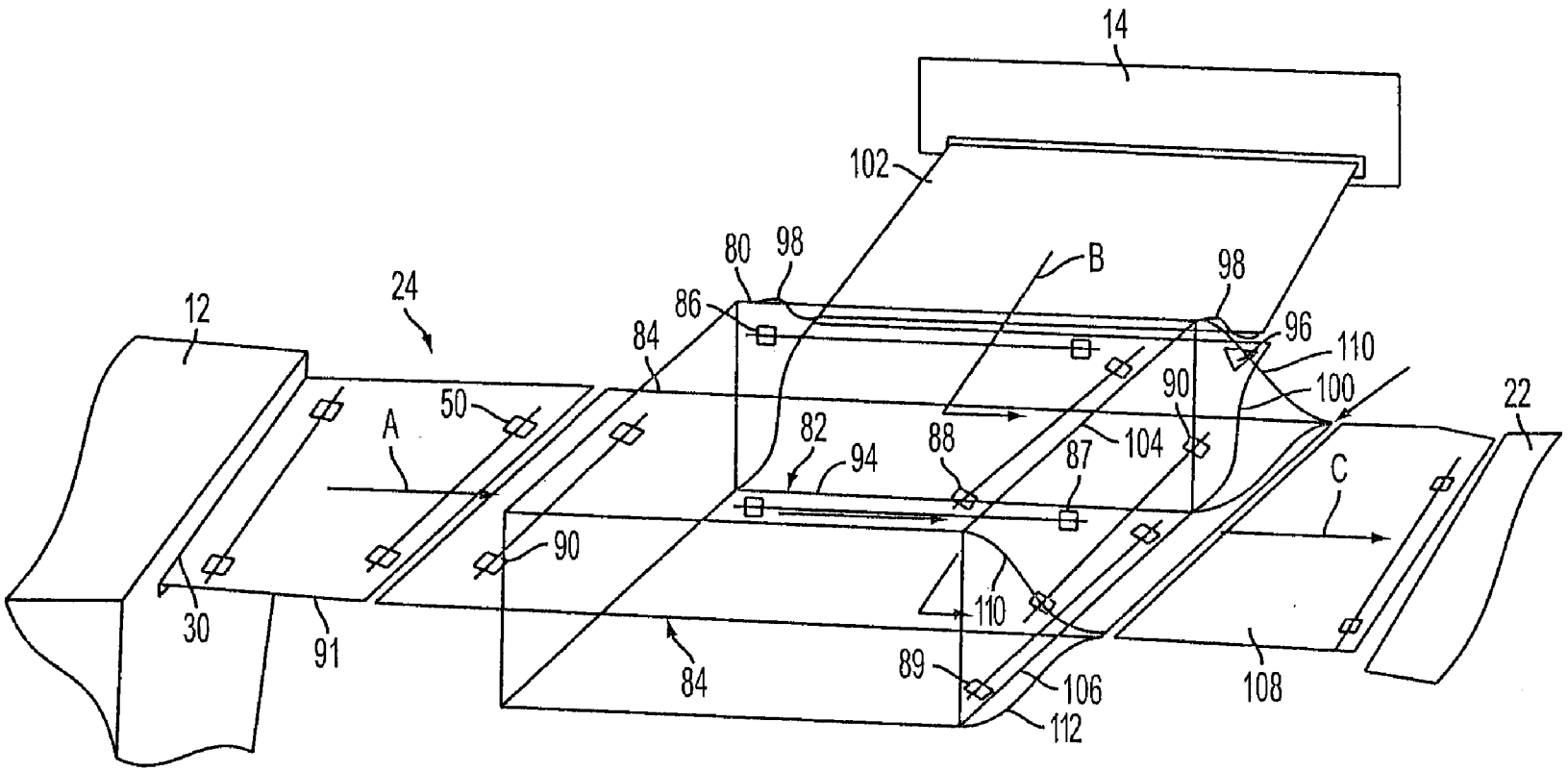
FIG. 4 is a schematic perspective view of the merge module of FIG. 1.

The merge module 20 operates to align the direction of output streams A and B so that they have the same direction and velocity. The merged stream C may be aligned in the same direction as one of the input streams (in FIG. 1, stream A) or may be in a different angular direction from both input streams. As shown in FIG. 4, the merge module 20 includes three media transport sections which provide three separate paths for print media: a first, upper media transport section 80, which defines a first print media transport plane, a second, lower media transport section 82, which defines a second print media transport plane, and a third, intermediate media transport section 84, intermediate the upper and lower sections 80, 82, which defines a third print media transport plane, spaced from the first and second planes. The illustrated first, second, and third media transport sections are vertically stacked, one on top of the other. Specifically, the three sections 80, 82, and 84 are spaced apart and generally parallel with each other to define the three spaced transport planes in which print media can be conveyed contemporaneously. In alternate embodiments, two or more of the media transport sections may be arranged in other orientations.

The sections 80, 82, 84 are each sized to accommodate one or more sheets of print media and include drive members 86, 87, 88, 89, 90 for conveying the sheets. In one mode of printing, media transport section 84 receives the entire output of marking engine 12 from a media path portion 91, while media transport sections 80, 82 each receive only a portion of the print media output by marking engine 14 (i.e., each section 80, 82 receives less than all, and typically about half of the output of marking engine 14). In an embodiment where the pages of a print job are split, e.g., equally, between the two marking engines 12, 14 for increased productivity, the sections 80, 82 each generally receive fewer sheets than the section 84, typically, about half the number of sheets received by section 84.

The drive members 90 in the intermediate section 84 maintain the same direction of travel and orientation of the print media sheets from marking engine 12 in the stream A. The sheets continuing along path A thus need not stop in the merge module 20 (i.e., can proceed through the merge module without stopping or slowing), although timing of merging may be facilitated by varying the sheet speed or stopping the sheets in some cases. One or both of the drive members 86, 88 in the upper section 80 and one or both of the drive members 87, 89 in the lower section 82 are configured for changing the direction of the sheet to that of the stream A. The changing direction involves decelerating and generally stopping the sheet in the respective upper or lower section 80, 82, then accelerating the sheet in a different direction, e.g., the direction of the stream A. Selected ones of the drive members 86, 87, 88, 89 (or additional drive members, not shown) may also be configured for rotating the sheet through an angle (θ) corresponding to the angular spacing between the incoming print media streams A, B, in the illustrated embodiment, by about 90°. In this way, the forward end F of the sheet is retained in a forward position. Alternatively, the rotation of the sheets arriving from the marking engine 14 may be performed in a separate part of the conveyor system 24, prior to or subsequent to merging.

The drive systems 86, 87, 88, 89 in sections 80, 82 (and optionally also elsewhere in the conveyor system) can include for example, airjet transport modules, spherical nips ("SNIPS") spin-roller drives, omni-directional drive systems, spherical paper moving devices, simple drive nip systems located at 90 degrees to one another with nip releases to selectively engage or disengage one set of drive nips, or independently controlled drive rollers which enable sheet translation and optionally rotation. Examples of such drive systems are described, for example, in above-mentioned U.S. application Ser. No. 10/785,211 (Published Application 20040253033) and Ser. No. 10/881,619, and in U.S. Pat. No. 5,090,683, incorporated herein by reference in their entireties. An airjet transport system, for example, is generally a paper transport system that uses flowing air instead of rollers to apply the motive force to the paper sheets to move the flexible sheet. The system controller 28 interacts with individual or local module controllers for the various airjets. By adjusting the pressure and/or direction of the airjets, and/or by selectively actuating different groups of airjets, sheets can be transported, redirected, and/or rotated through variable angle sheet driving directions. The airjets can provide a variable velocity as well as a variable angle sheet movement system.

An example of a SNIPS paper moving device for two-axis sheet movement and/or rotation is described in U.S. Pat. No. 6,059,284 to Wolf, et al., the disclosure of which is incorporated herein by reference in its entirety. Each SNIPS sheet drive has a spherical frictional drive ball engaging any overlying sheet, which drive ball is rotated in any desired direction and speed by two orthogonal servo-driven rollers drivingly engaging the opposite side of the ball. Similar transport systems which may be employed are disclosed in U.S. Pat. No. 4,836,119 to Siraco, et al. and U.S. Pat. No. 6,241,242 to Munro, incorporated herein by reference in their entireties. Overlying idler balls, pneumatic pressure or suction, or other known paper feeding normal force systems may be added, if desired, to hold the sheets down against the drive balls in addition to sheet gravity.

The airjet transport, spherical nips, and omni-direction drives are all examples of transport mechanisms which are capable of moving a sheet in any direction in a plane defined by mutually perpendicular X and Y axes as well as rotation, within the plane, through any angle (i.e., three degrees of freedom). These embodiments can move the part in any direction, including velocity direction, at any time, not just the axes perpendicular to the roller axis as in traditional transport systems.

In a roller system, the angle through which rotation/redirection occurs in the plane may be more limited, for example, sheets may be rotated through a preselected angle, such as 90° and/or redirected from a first direction to a second direction perpendicular to the first direction. Or, two-way rollers (where one set of rollers is angled to another set) may permit motion in directions at non-perpendicular angles to the roller axle. In one embodiment, a number of rollers are grouped into perpendicular arrays so that a force in any one direction within the plane can be exerted on the object by appropriate torque applied to the rollers in one of the two orthogonal directions, while opening or releasing the rollers in the other direction using solenoids, cams, or other actuators. The object is free to move in the direction of the closed and driven rollers.

Examples of other drive systems that can be used in the transport sections 80, 82 for redirection and/or rotation of sheets are disclosed, for example in above-mentioned U.S. Pat. Nos. 6,607,320, 6,554,276, 5,090,683, 5,931,462, 6,811,152, and 5,836,439, incorporated herein by reference.

By way of example, a sheet enters section 80 (or 82) of the merge module 20 at input speed and is stopped. In particular, the sheet is received by upstream drive members 86 (or 87) comprising spaced pairs of rollers having an axis of rotation perpendicular to direction A which define a nip therebetween in the respective transport plane. In FIG. 4, only the upper (e.g., driven) rollers of each pair are illustrated for convenience. The rollers are controlled to grasp an upstream end of a sheet tightly, once it is positioned on the respective transport section 80, 82. This stops the movement of the sheet. Downstream drive members 88 (or 89) then engage the sheet. Once the downstream drive members 88 or 89 are in engagement with the sheet, the upstream drive members 86 (or 87) disengage from the sheet. As soon as the nips of the upstream drive members 86 (or 87) are released, they can be returned to input speed, ready to receive the next sheet from marking engine 14. The downstream drive members 88 (or 89) are then driven to accelerate the sheet in a direction orthogonal to the incoming direction. The drive members 88, 89 may be similarly configured to drive members 86, 87 with an axis of rotation perpendicular and in the same plane to the axis of rotation of drive members for redirection without rotation. In this embodiment, rotation may be provided by drive members 88 and 89 (operating in a similar manner to that described in U.S. Pat. No. 5,090,683), or optionally be provided by other drive members, either in the section 80, 82, or elsewhere.

In another embodiment, the downstream drive members 88 of section 80 and/or the downstream drive members 89 of section 82 may be of the type which allow rotation as well as redirection, such as those described in above-mentioned U.S. Pat. Nos. 5,090,683 and 5,836,439, incorporated by reference. In one embodiment, the drive members 88, 89 comprise spaced pairs of rollers which define nips. The pairs of rollers may be separately controlled to accelerate then decelerate in opposite directions to rotate the sheet 90°, as described in U.S. Pat. No. 5,836,493. In another embodiment, drive members 88, 89 each comprise a fixed speed roller and a spaced variable speed roller, as described in U.S. Pat. No. 5,090,683. Once rotation is complete, the drive members 88, 89 then accelerate the sheet to output speed.

To direct print media selectively from stream B to one of sections 80, 82, upstream ends 92, 94 of the upper and lower sections 80, 82 are selectively connected with the marking engine 14 by a selectable decision gate 96 (FIG. 4). In the illustrated embodiment, two inlet path portions 98, 100, which diverge from the decision gate in upward and downward directions, respectively, couple the upper and lower sections 80, 82 with a path portion 102, which receives printed sheets from marking engine 14. The path portions 98, 100 may be defined by spaced pairs of baffles (not shown) which constrain the print media to travel in the desired direction and may further include one or more drive members 50. The decision gate 96 may be under the control of the control system 28. Downstream ends 104, 106 of sections 80, 82 feed into a path portion 108 of the path A, downstream of the merge module, in module 62, which also receives print media from marking engine 12. Respective upper and lower merge paths 110, 112 from the upper and lower sections 80, 82, respectively, may be defined by pairs of spaced baffles (not shown) and may optionally include drive members 50. As shown in FIG. 2, the lower merge path 112 may enter the section 108 at a location spaced, e.g., downstream, of the upper merge path 110.

Sheets of print media from marking engine 14 can be directed alternatively to the upper and lower sections 80, 82, changed directions and optionally rotated, and then be merged with sheets in the stream A. Rotation generally involves turning the sheet through 90° in the plane of the sheet, i.e., in the plane of the upper or lower section 80, 82. Because the changing direction generally involves stopping the motion of the sheet, and the optional rotation of the sheet also takes some time, the time taken to redirect the sheets in stream B from marking engine 14 is generally longer than the time taken for sheets to pass through the merge module 20 in direction A. Having two (or more) equivalent sections 80, 82, for performing the rotation/redirection functions allows these functions to be performed without slowing marking engine 14 by keeping sheets exiting marking engine 14 from interfering with each other. In some cases, the equivalent sections 80, 82 may allow sheets to be merged in the merge module without requiring a slowing of the output of marking engine 12, particularly if the object is to alternate pages. It will be appreciated that the three sections 80, 82, 84 can be stacked in any convenient order. For example sections 80 and 82 may both be above or both be below section 84.

A downstream end of the path portion 108 is connected with the finisher 22. It is to be appreciated that more than one finisher may be provided and accessed serially from path 108 or accessed from path 108 via branch or bypass pathways. Only one finisher 22 is shown for clarity. Output destinations 44, 46, 48 are shown in this embodiment as being arranged in parallel, however, they may be arranged sequentially, in any combination of sequential and parallel arrangements, or in any other suitable manner. The operation of output destinations 44, 46, 48 may be coordinated individually, in groups, or all together.

For given print job, all the sheets forming the job may be collated at the same output destination, such as tray 44. In the illustrated embodiment, the merge module 20 is downstream of all the marking engines in the system 10, although it also contemplated that further marking engines or postprinting treatment processors may be coupled between the merge module 20 and the finisher 22.

In one embodiment, sheets from section 80 are timed to arrive at portion 98 of the merge module to be stacked on top of a sheet traveling along path A while sheets from section 80 are timed to arrive at portion 108 of the merge module 20 to be stacked beneath a sheet traveling along path A. Alternatively, sheets from marking engine 14 are inserted in intersheet gaps between sheets from marking engine 12.

Figure 5:
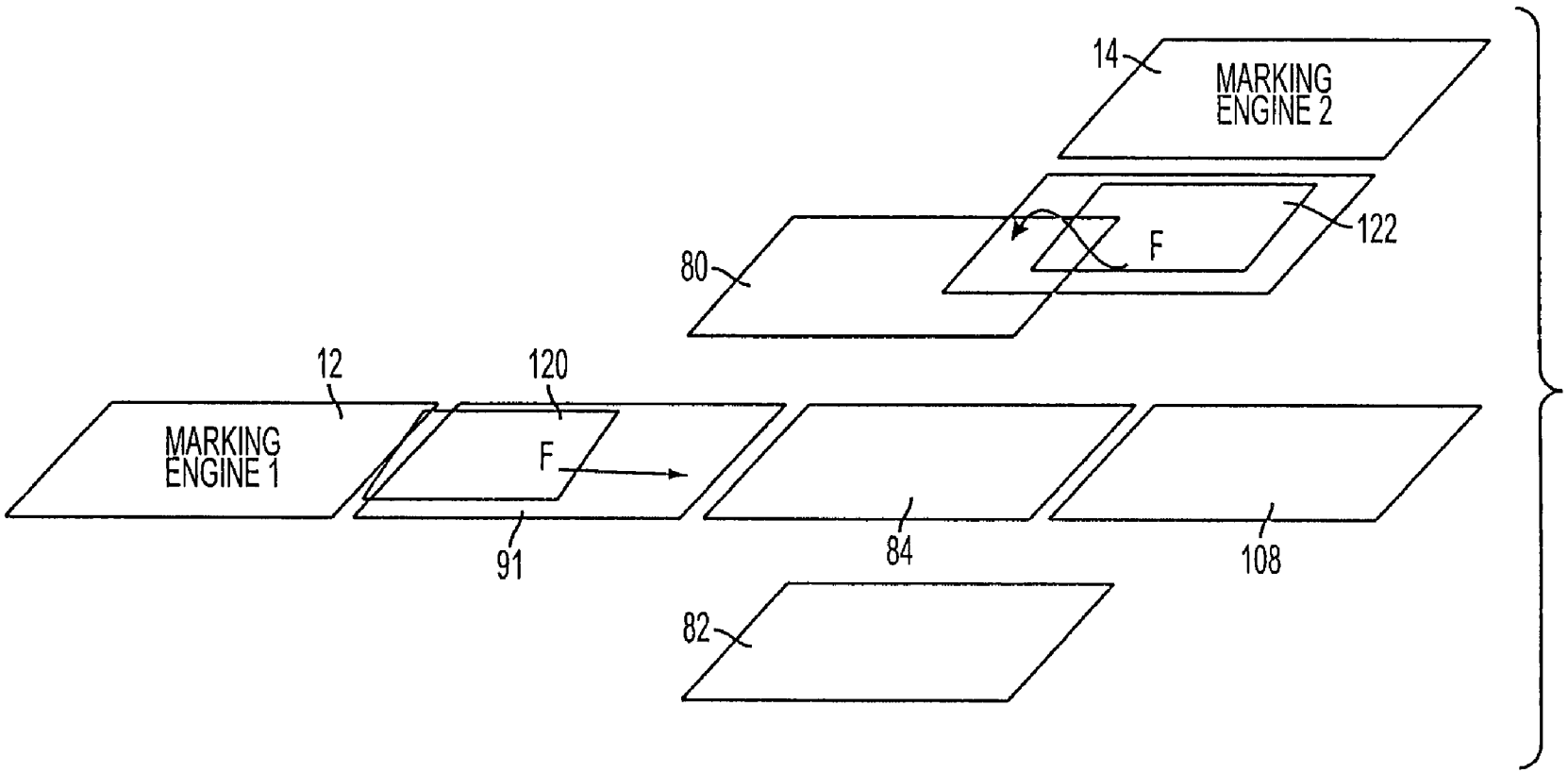
FIG. 5 is a schematic view of a first step in a merging process.
Figure 6:
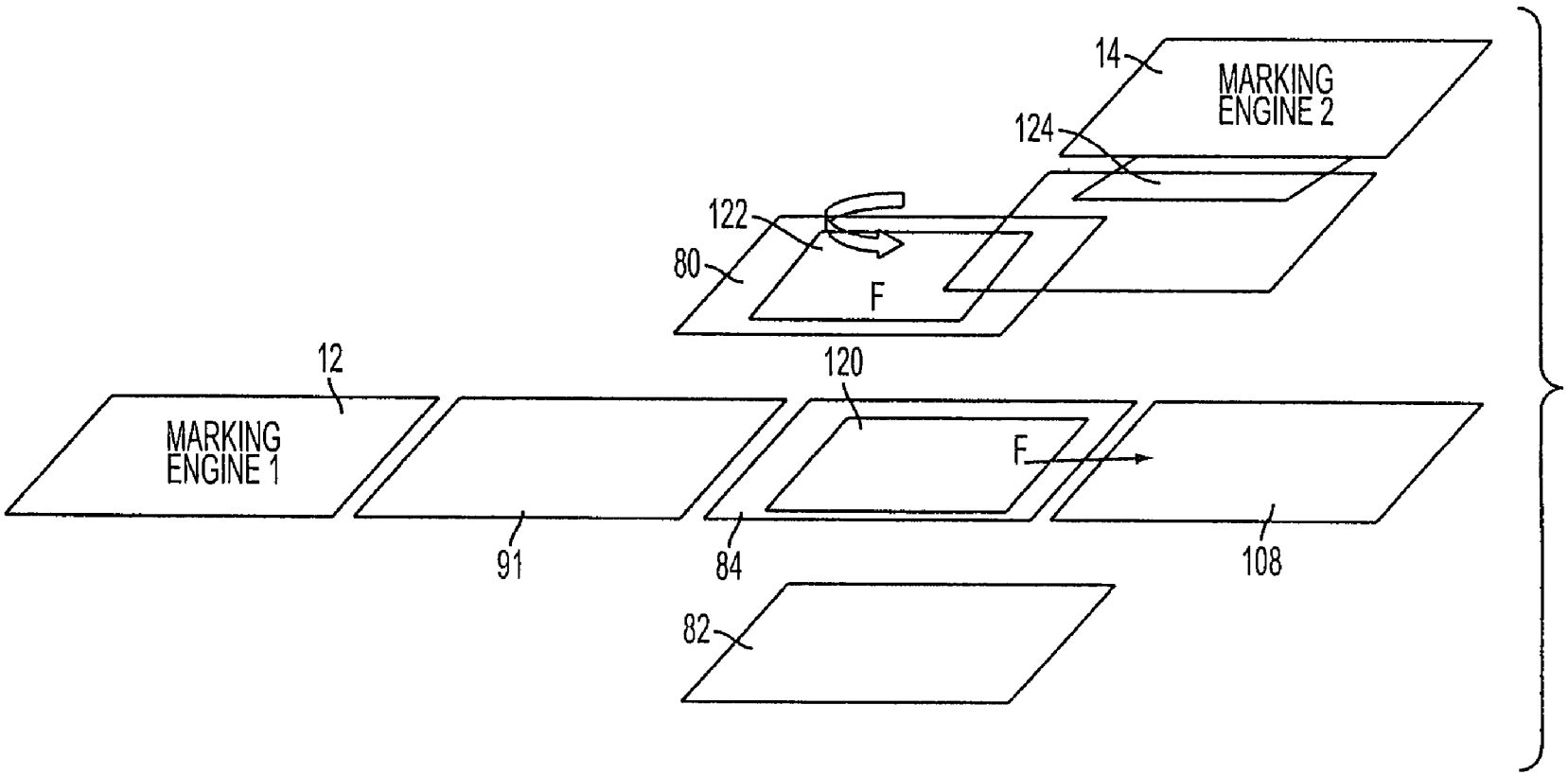
FIG. 6, is a schematic view of a second step in a merging process, subsequent to the first step.
Figure 7:
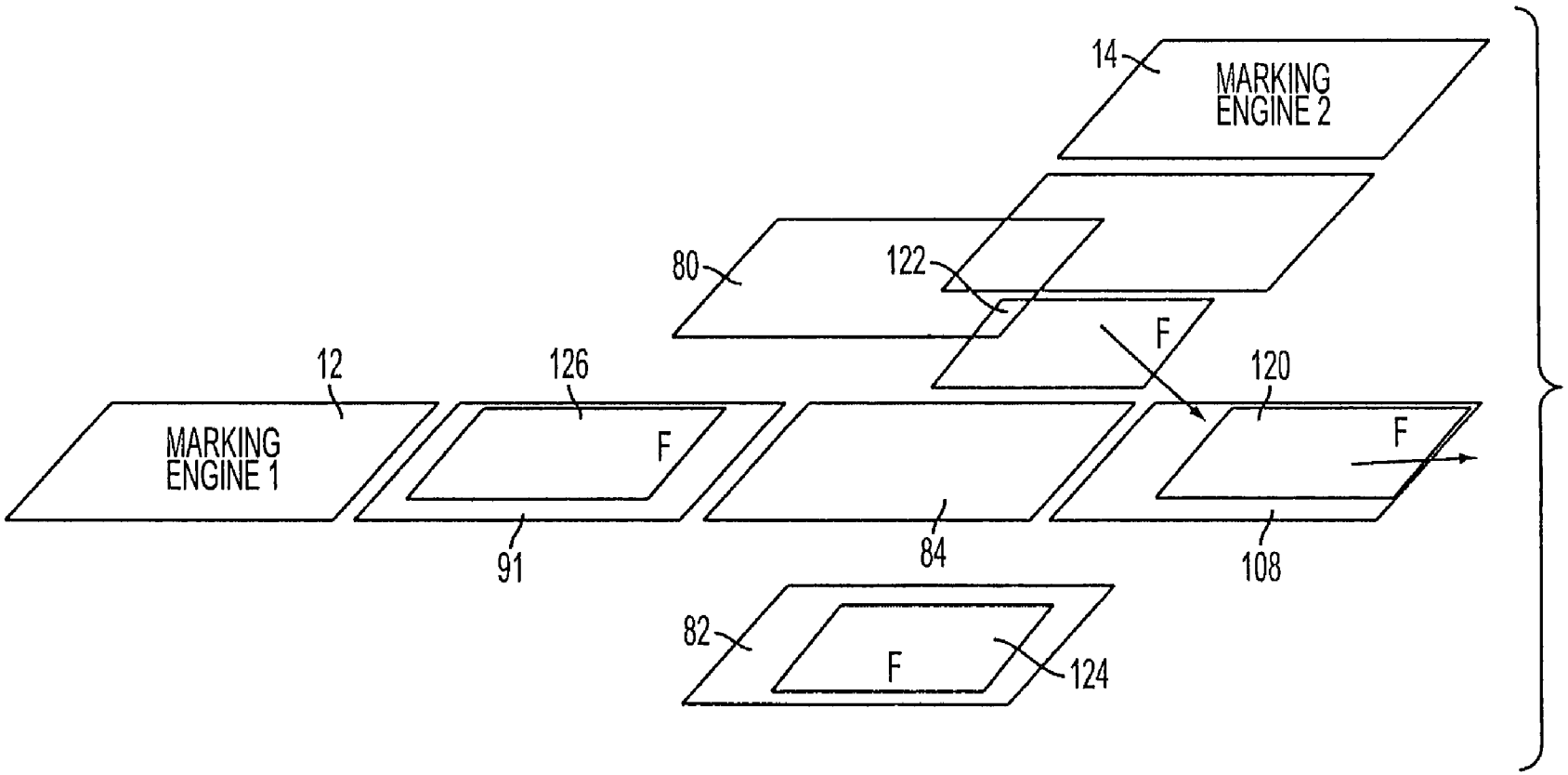
FIG. 7 is a schematic view of a third step in a merging process, subsequent to the second step.
Figure 8:
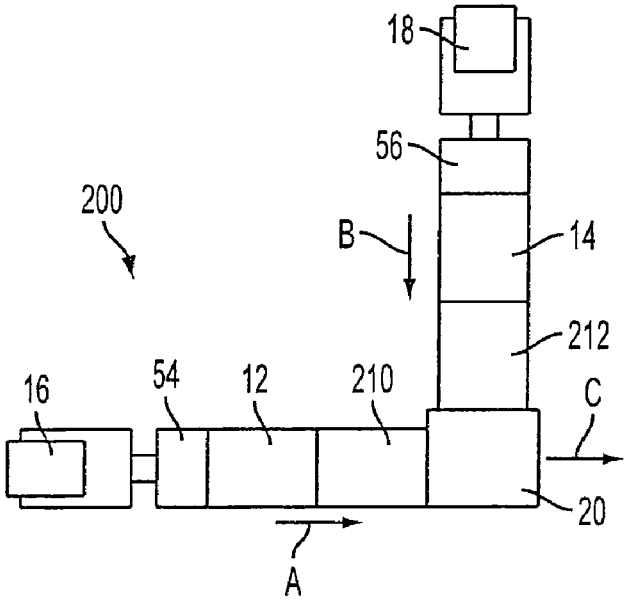
FIG. 8 is a schematic top plan view of an exemplary printing system according to a second aspect of the exemplary embodiment.

FIGS. 5-7 provide an illustration of an exemplary merging of groups of sheets from a print job in which a first group of sheets from stream B is merged with a second group of sheets from stream A. F indicates the end of the sheet which will be forward facing after merging. Sheet 120 (duplex printed with pages 1 and 2 of the print job) is timed to arrive at the merge module contemporaneously with or shortly after sheet 122 (duplex pages 3 and 4), as illustrated in FIG. 5. While sheet 122 is undergoing redirection and rotation on section 80, sheet 120 crosses section 84 and proceeds to outlet path 108 (FIG. 6). As sheet 120 leaves path portion 108, sheet 122 is inserted into the outgoing stream C behind sheet 120. At the same time, another sheet 124 (pages 7 and 8 of the print job) from stream B is moving to section 82. While sheet 124 undergoes rotation and redirection, another sheet 126 (pages 5 and 6 of the print job) from stream A passes through the merge module 20 on path section 84 (FIG. 7). Sheet 124 is inserted in stream C in path section 108, behind sheet 126. The cycle continues until all pages of the print job are merged.

While in the illustrated embodiment, the merge module 20 is shown as a separate module, it is also contemplated that the merge module may be incorporated into the media path of the finishing system 22 or the marking engine 14.

The merge module 20 may be disconnected from the printing system 10 to allow the system to be reconfigured. For example, if the productivity of a two engine printing system is no longer desired, the second marking engine 14 and the merge module 20, or at least the upper and lower sections 80, 82, may be disconnected from the printing system.

The exemplary embodiment enables a maximum print rate of the printing system (e.g., expressed in prints per minute, ppm) to be equivalent (or close to) the sum of the maximum outputs, in ppm, of the two marking engines 12, 14. In prior systems, merging of print media from two or more high speed marking engines generally results in some loss in productivity, which is more noticeable as the speed of the marking engines increases. As will be appreciated, the capacity of the finisher 22 may provide a rate limiting step if it does not have the capacity to handle the outputs of two streams A, B at the desired output speed. In the exemplary embodiment, the finisher 22 configured for handling the maximum outputs of both marking engines 12, 14, at least for some print jobs.

In the event that heavyweight media, tabs, or other specialty stock is being used, the printing system may optionally operate without merging the outputs of marking engines 12, 14 (e.g., with only one of the marking engines 12, 14 operating).

The modularity of merge module 20 may greatly simplify the design and development of the printing system 10. This modularity also enables scalability of printing system 10, where feeder modules 16, 18, marking engines 12, 14, and output destinations 44, 46, 48 may be added or removed as desired.

It should be understood that merge module 20 may include any number of media path sections 80, 82, 84, in any combination. Merge module sections 80, 82 may also be configured as buffers to temporarily hold print media, for example, each holding several sheets which have been printed out of the ultimate page order sequence.

FIGS. 8-14 show schematic views of other embodiments of a radial merge printing system, which may be similarly configured to printing system 10, except as otherwise noted. In these embodiments, similar elements are accorded the same numerals and new elements are accorded new numerals. In the printing system 200 of FIG. 8, in addition to marking engines 12, 14, two additional marking engines 210, 212 are provided in paths A and B respectively. For example the combination of marking engines 12 and 210 provides tandem engine duplex printing (marking engine 12 printing a first side of the sheet and marking engine 210 printing the opposite side of the same sheet) for stream A. Similarly, marking engines 14, 212 provide tandem engine duplex printing of the sheets in stream B. The marking engines, in this embodiment, do not need the return loop 34. Or, marking engines 12, 210 may b of different print modalities, such as a monochrome and a process color printer. The merge module 20 changes the direction and optionally rotates the sheets from stream B so that they can be merged into stream A as described for the embodiment of FIGS. 1-7.

Figure 9:
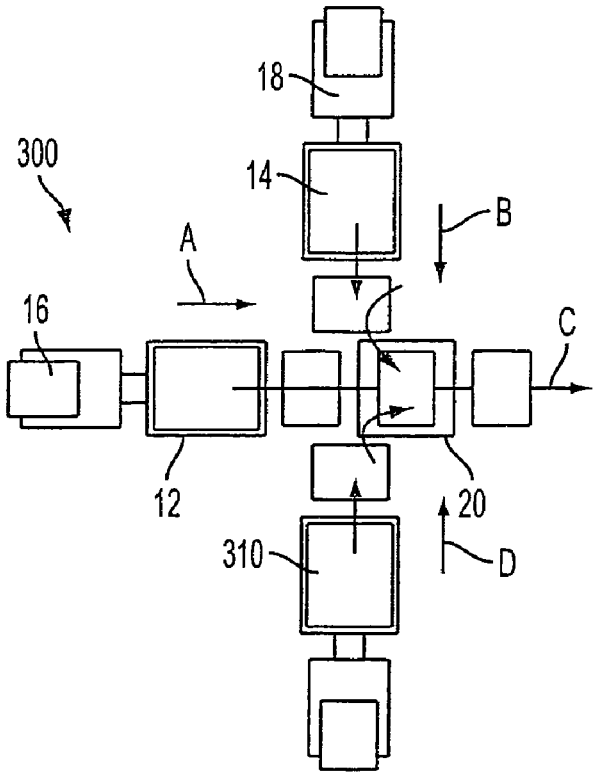
FIG. 9 is a schematic top plan view of an exemplary printing system according to a third aspect of the exemplary embodiment.

In the radial merge printing system 300 of FIG. 9, sheets are input to the merge module 20 at right angles, from streams A and B from marking engines 12, 14. An additional stream D is merged with streams A and B. Stream D is output by a marking engine 310, and is input to the merge module 20 from an opposite direction to stream B, at right angles to stream A. In this embodiment, streams B and D are merged with stream A by redirection and rotation of the sheets in the merge module. The merge module 20 may include more than two redirection sections 80, 82, in this embodiment, such as two redirection sections for stream B and two redirection sections for stream D. In this embodiment, marking engine 12 may have a higher speed than marking engines 14, 310, for example, outputting at a rate which is approximately equal to the combined outputs of marking engines 14 and 310. Or, one of the marking engines 310 may be a color marking engine and may be used for printing color pages of a print job while other marking engines 12 and 14 may be monochrome engines.

Figure 10:
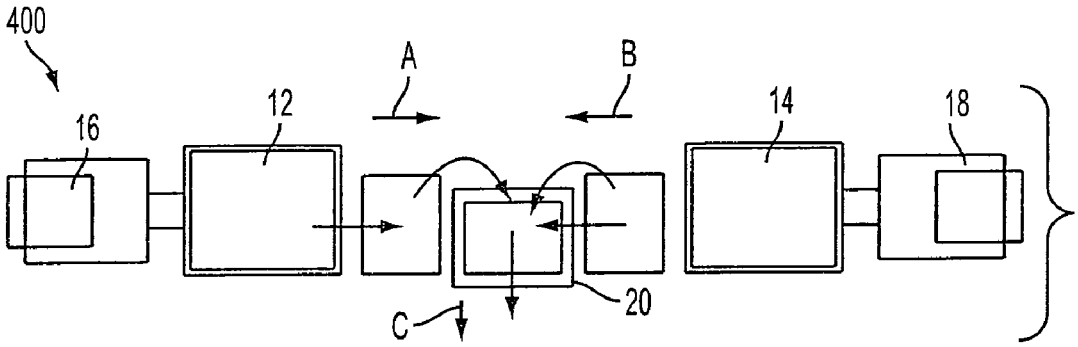
FIG. 10 is a schematic top plan view of an exemplary printing system according to a fourth aspect of the exemplary embodiment.

In the radial merge printing system 400 of FIG. 10, streams A and B from marking engines 12 and 14 arrive at the merge module 20 in opposite directions, i.e., the streams are radially spaced by an angle of about 180°. The streams A, B, are merged onto a common output stream C. Since both streams are rotated and redirected, the time that sheets from each stream spend in the merge module 20 is approximately equal. Thus, in this embodiment, there need only be two transport sections analogous to sections 80, 84, however, in this case, sections 80 and 84 may both be configured for redirection and optionally rotation, in a similar manner to section 80 of FIG. 1.

Figure 11:
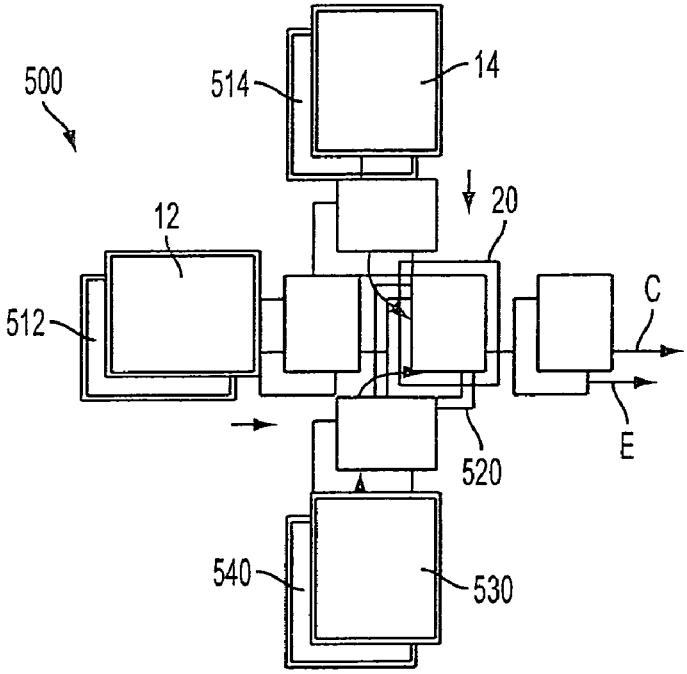
FIG. 11 is a schematic top plan view of an exemplary printing system according to a fifth aspect of the exemplary embodiment.

In the radial printing system 500 of FIG. 11, two merge modules 20, 520 are cascaded. In this embodiment, marking engines 12, 14 feed streams to merge module 20, while marking engines 512, 514, which may be vertically stacked below marking engines 12, 14, respectively, feed streams of print media to merge module 520, which may be vertically stacked below merge module 20. Merge module 520 may be similarly configured to merge module 20. The two merge modules may be configured to merge into a single output stream or may output two streams C, E, as shown. Streams E and C may be merged by feeding one stream into the other or by directing both streams into a common path. Optionally, fifth and sixth marking engines 530, 540 may be provided, analogous to marking engine 310.

Figure 12:
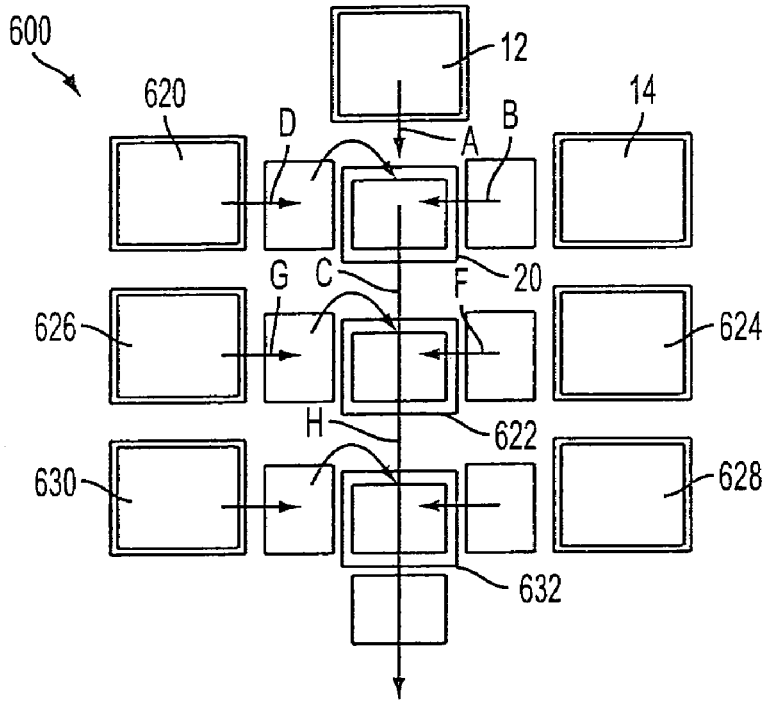
FIG. 12 is a schematic top plan view of an exemplary printing system according to a sixth aspect of the exemplary embodiment.

In the radial printing system 600 of FIG. 12, marking engines 12, 14, and optionally 620 are merged at merge module 20 and output as a stream C in a similar manner to that described for printing system 10 or 300. Stream C then provides an input for a second merge module 622, where stream C is merged with a stream F from a marking engine 624 traveling orthogonally to stream C and optionally with another stream G from a marking engine 626. The merged streams are output as stream H, coaxial with stream C. Optionally, stream H may in turn be merged with streams from one or more additional marking engines 628, 630 at a merge module 632, and so forth.

Figure 13:
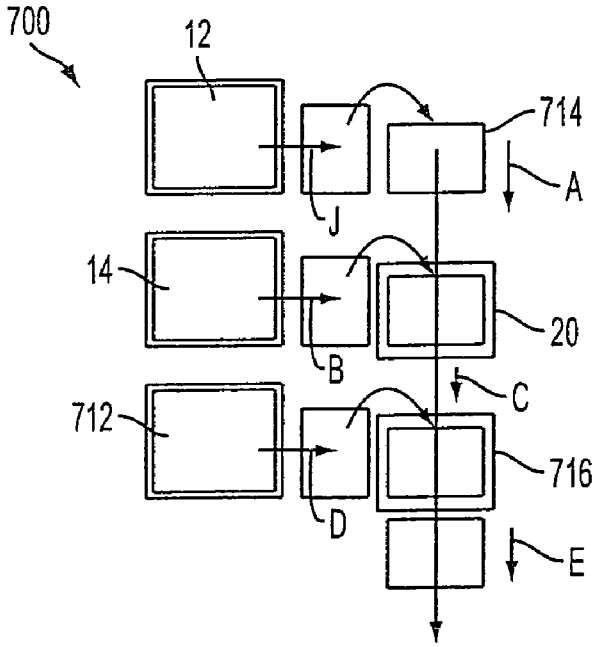
FIG. 13 is a schematic top plan view of an exemplary printing system according to a seventh aspect of the exemplary embodiment.

In the printing system 700 of FIG. 13, all of the marking engines 12, 14, 712 are oriented to output print media in the same direction and in parallel. Marking engine 12 generates a stream J of sheets, which sheets are rotated and redirected in a rotation module 714 prior to entering a merge module 20 from direction A. Rotation module 714 may be in the same plane as input stream A. Marking engine 14 generates a stream B of print media sheets which are rotated in merge module 20 in a similar manner to that described for FIG. 1 and merged with stream A in a similar manner to that described for FIGS. 1-7. The merged stream C may provide the input for a second merge module 716, where stream C is merged with a stream D from marking engine 712 in a similar manner to that described for FIGS. 1-7. The rotation module 714 may be similarly configured to those described in U.S. Pat. No. 5,090,683 or U.S. Pat. No. 5,931,462.

Figure 14:
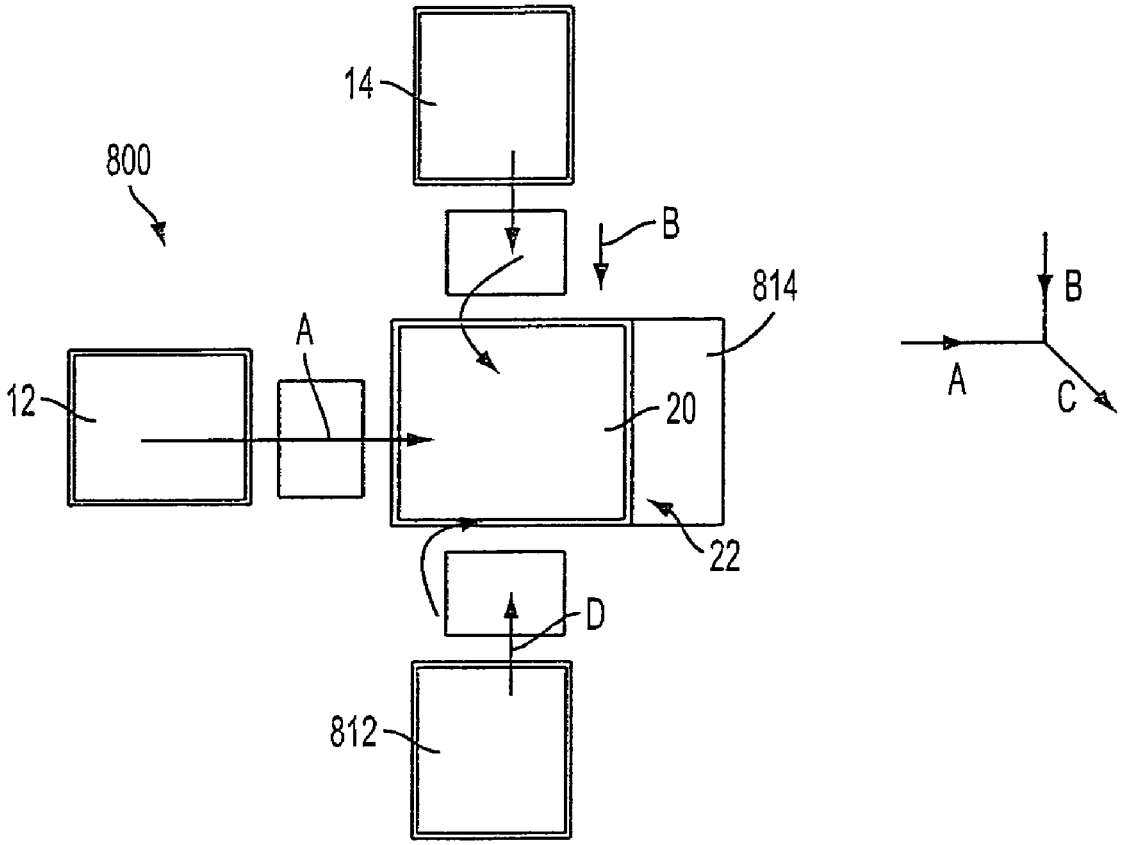
FIG. 14 is a schematic top plan view of an exemplary printing system according to an eighth aspect of the exemplary embodiment.

In the printing system 800 of FIG. 14, the merge module 20 and finisher 22 are in the same module, and may be vertically stacked. Thus, for example, stream A from marking engine 12 is merged with stream B from marking engine 14 and optionally with stream D from marking engine 812 and the merged stream is assembled in the finisher 22, for example in a stacker tray 814.

Other printing system configurations in which the exemplary merge module may be used are disclosed, for example, in above-mentioned U.S. application Ser. No. 11/166,581 by Lang, et al., incorporated herein by reference in its entirety. Thus, the disclosed embodiments provide a high level of flexibility in terms of media routing where various components of a printing system may be coupled to selectively supply other components. This provides operational flexibility and redundancy, allows for high speed parallel operations, and greatly reduces the size and complexity of the media path because there is no need to provide sheet transports that go over the other marking engines in the system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first marking engine which outputs a first stream of print media in a first direction of travel;

a second marking engine which outputs a second stream of print media in a second direction of travel, angularly spaced from the first stream direction;

a merge module which receives the first and second streams from the angularly spaced first and second directions of travel, the merge module comprising:

a first media transport section which receives print media from the first stream of print media and outputs the print media in a first output direction;

a second media transport section and a third media transport section which selectably receive print media from the second stream of print media, the second and third media transport sections being configured for redirecting the print media from the second stream whereby the print media from the second print media stream is oriented in the first output direction for merging with the printed media from the first stream; and an output path coupled with the first media transport section and the second and third media transport sections in which the print media from the first and second streams are merged.

2. The printing system of claim 1, wherein the second transport section receives a first portion of the print media in the second stream and the third media transport section receives a second portion of the print media in the second stream.

3. The printing system of claim 2, wherein at least one of the second and third transport sections includes spherical drive nips, each of the spherical drive nips being configured for driving print media in at least two angularly spaced directions.

4. The printing system of claim 1, wherein at least one of the second and third media transport sections rotates print media from the second stream.

5. The printing system of claim 4, wherein the at least one of the second and third transport sections includes a first set of drive members which define a nip therebetween and a second set of drive members which define a nip therebetween, and wherein the first nip is generally orthogonal to the second nip.

6. The printing system of claim 5, wherein the first and second sets of drive members are configured for opening and closing to grip the print media and release the print media, and the first and second sets of drive members are separately controllable whereby when the first set of drive members grips the print media, the print media is driven in a first direction, and whereby when the second set of drive members grips the print media, the print media is driven in a second direction, generally orthogonal to the first direction.

7. The printing system of claim 1, wherein in a mode of printing, the sheets of printed media in the second stream are delivered alternately to the second and third media transport sections.

8. The printing system of claim 1, wherein the merge module transports the printed media in the first stream therethrough without rotation.

9. The printing system of claim 8, wherein the first and second streams of print media are oriented to each other at approximately 90°.

10. The printing system of claim 1, wherein the first media transport section rotates the print media from the first stream.

11. The printing system of claim 10, wherein the first and second streams of print media are oriented to each other at approximately 180°.

12. The printing system of claim 10, wherein the first and second marking engines are angularly spaced from the merge module.

13. The printing system of claim 1, wherein the marking engines are xerographic marking engines.

14. The printing system of claim 1, wherein at least one of the marking engines includes a return loop for duplex printing.

15. The printing system of claim 1, wherein the merge module is configured for merging print media outputs of the second and third media transport sections with a print media output of the first media transport section.

16. The printing system of claim 1, wherein the first, second, and third media transport sections are vertically stacked.

17. The printing system of claim 1, wherein the second media transport section is located above the first media transport section and the third media transport section is located below the first media transport section.

18. The printing system of claim 1, further comprising a finisher which receives a merged stream of print media from the merge module.

19. A method of printing with the printing system of claim 1, comprising:

supplying the first stream of print media to the first media transport section of the merge module for merging with the second stream of print media;

outputting the first stream of print media from the first media transport section in a first direction;

supplying a first portion of the second stream of print media to the second media transport section of the merge module;

supplying a second portion of the second stream of print media to third media transport section of the merge module;

redirecting the second stream of print media in the second and third media transport sections from a second direction to the first direction;

outputting the first and second portions of the second stream of print media from the second and third media transport sections in the first direction; and merging the first and second streams.

20. A printing system comprising:

a first marking engine which outputs a first stream of print media;

a second marking engine which outputs a second stream of print media;

a merge module which receives the first and second streams from angularly spaced directions, the merge module comprising:

a first media transport section which receives print media from the first stream of print media and outputs the print media in a first direction;

a second media transport section and a third media transport section which selectably receive print media from the second stream of print media, the second and third media transport sections being configured for redirecting the print media from the second stream whereby the print media from the second print media stream is oriented in the first direction for merging with the printed media from the first stream, wherein the second transport section receives a first portion of the print media in the second stream and the third media transport section receives a second portion of the print media in the second stream;

a gate for selectably delivering printed media from the second stream to the second and third transport sections; and an output path coupled with the first media transport section and the second and third media transport sections in which the print media from the first and second streams are merged.

* * * * *